United States Patent [19]

Schlacht

[11] Patent Number: 4,592,796

[45] Date of Patent: Jun. 3, 1986

[54] DEVICE FOR THE APPLICATION OF LABELS TO CYLINDRICAL CONTAINERS

[75] Inventor: Ernst Schlacht, Berlin, Fed. Rep. of Germany

[73] Assignee: Weiss Etikettiertechnik GmbH+Co. KG, Berlin, Fed. Rep. of Germany

[21] Appl. No.: 675,331

[22] Filed: Nov. 27, 1984

[30] Foreign Application Priority Data

Dec. 9, 1983 [DE] Fed. Rep. of Germany ..... 3345126

[51] Int. Cl.[4] ..... B65C 9/06; B65C 9/16

[52] U.S. Cl. ..... 156/450; 156/455; 156/458; 156/568; 156/571; 156/578; 156/DIG. 26; 156/DIG. 29; 156/DIG. 32

[58] Field of Search ..... 156/449, 450, 455, 458, 156/568, 571, 578, DIG. 26, DIG. 29, DIG. 32

[56] References Cited

U.S. PATENT DOCUMENTS 2,773,617 12/1956 Weiss ..... 156/568
3,858,869 1/1975 Campbell et al. ..... 156/568
4,108,710 8/1978 Hoffmann ..... 156/450
4,336,095 6/1982 Hoffmann ..... 156/458

FOREIGN PATENT DOCUMENTS 2203996 8/1979 Fed. Rep. of Germany .

*Primary Examiner*—Michael Wityshyn
*Attorney, Agent, or Firm*—Michael J. Striker

[57] ABSTRACT

A device for the application of labels onto the periphery of cylindrical containers, which are advanced at intervals from each other, comprises a continually rotating drum which carries a stationary gripping member and a movable gripping member, which receive cold glue from a glue supply device and grip the uppermost label from the stack of labels to transmit this label to one of the advanced containers. The movable gripping member is movable under the control of a cam arrangement toward the front end of the label being transmitted and carries that front end therealong whereas the stationary gripping member while passing the rear end of the label applies glue to that rear end.

7 Claims, 9 Drawing Figures

DEVICE FOR THE APPLICATION OF LABELS TO CYLINDRICAL CONTAINERS

BACKGROUND OF THE INVENTION

The present invention relates to a device for the application and gluing labels to cylindrical containers.

Devices for applying labels to cylindrical surfaces of containers of the foregoing type are generally known. One of such devices is disclosed, for example in DE-AS No. 2,203,996. Various proposals have been made to save the amounts of glue utilized for the application of labels to cylindrical containers. It is superfluous to note that such known methods as covering with glue of complete surfaces of labels as well as the application of glue in a strip-like form onto the label have required huge amounts of glue in mass production.

Research has been made particularly with round labels to obtain gluing of the labels by applying glue only to the front end and the rear end of such label. Such arrangement, however, has presented constructive difficulties.

An experiment, which has been conducted wherein, in order to use cold glue in desired manner, the label box has been oscillated relative to the glue roll so as to coat the front and rear end of the label with glue, has failed because the oscillating masses in processing of large quantities of labels are not controllable.

It has been also attempted to use the stationary label container and to utilize a hot glue aggregate to apply glue to the front and rear ends of the labels being processed. However, hot glue is much more expensive than cold glue and the utilization of special heating aggregates has required such costs that this known method has been also found non-satisfactory in mass production.

SUMMARY OF THE INVENTION

It is an object of the present invention to provide an improved device for the application of labels, the front and rear ends of which are coated with cold glue, to the outer surfaces of cylindrical containers, for example cans or glass containers, which device would be suitable for mass production.

This and other objects of this invention are attained by a device for the application of labels to cylindrical containers, comprising conveying means for advancing cylindrical containers to a work position; separating means for positioning the cylindrical containers at equal intervals from each other on said conveying means; drive means and counter surface means for rolling said containers which are received from said conveying means at the work position; a gluing mechanism; label-containing box means; and a rotary label-transmitting drum positioned against said box means for removing an uppermost label from said box and transmitting said label along a periphery of the drum to said drive means and said counter surface means, said label-transmitting drum including at least one movable gripping segment which receives cold glue from said gluing mechanism and, upon the rotation of said drum, comes into contact with a front end of the uppermost label and takes said front end along upon a further rotation of the drum, and at least one stationary gripping segment which receives cold glue from said gluing mechanism and, upon rotation of said drum, comes into contact with a rear end of the uppermost label, said drum further including cam control means having a cam roller and a cam groove for guiding said cam roller, said cam control means controlling the movement of said movable segment when the latter is positioned against the front end of the uppermost label. Two movable gripping segments and two stationary gripping segments may be provided on the periphery of said drum, which are offset relative to each other by 180°.

If the length of the labels is equal or smaller than the length of the movable segment the latter may have immediate zones for applying glue to the front end and the rear end of the label being removed from said box means, then the stationary segment can be omitted.

The movable gripping segment may further include lever means and a gripping portion, said lever means connecting said cam roller to said gripping portion.

The lever means may include two pivotable levers having pivot points, which are arranged on the same circumference on said drum.

The lever means may include two pivotable levers having the pivot points, of which one pivot point is arranged on one circumference and another pivot point is arranged on another circumference on said drum, said one circumference being of a diameter which does not exceed the diameter of said another circumference by a maximal double diameter of said cam roller.

The lever means may further include a rod connecting said pivotable levers to each other.

The label-application device may further comprise a wiper at said work position and a counter pressure roller in the proximity of said box means, said movable segment under the influence of said cam roller and during the continual rotation of said drum transmits the uppermost label to said wiper, moves to said gluing mechanism to receive a new portion of cold glue therefrom, then comes into contact with a next uppermost label in said box means, moves into the stack of labels, performs a brief rearward-and-lifting movement and moves further to said wiper with the label stuck thereto whereas the stationary segment provided with glue from the gluing mechanism comes into contact with the rear end of said label and coats the latter with glue when the stationary segment passes by said counter pressure roller.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
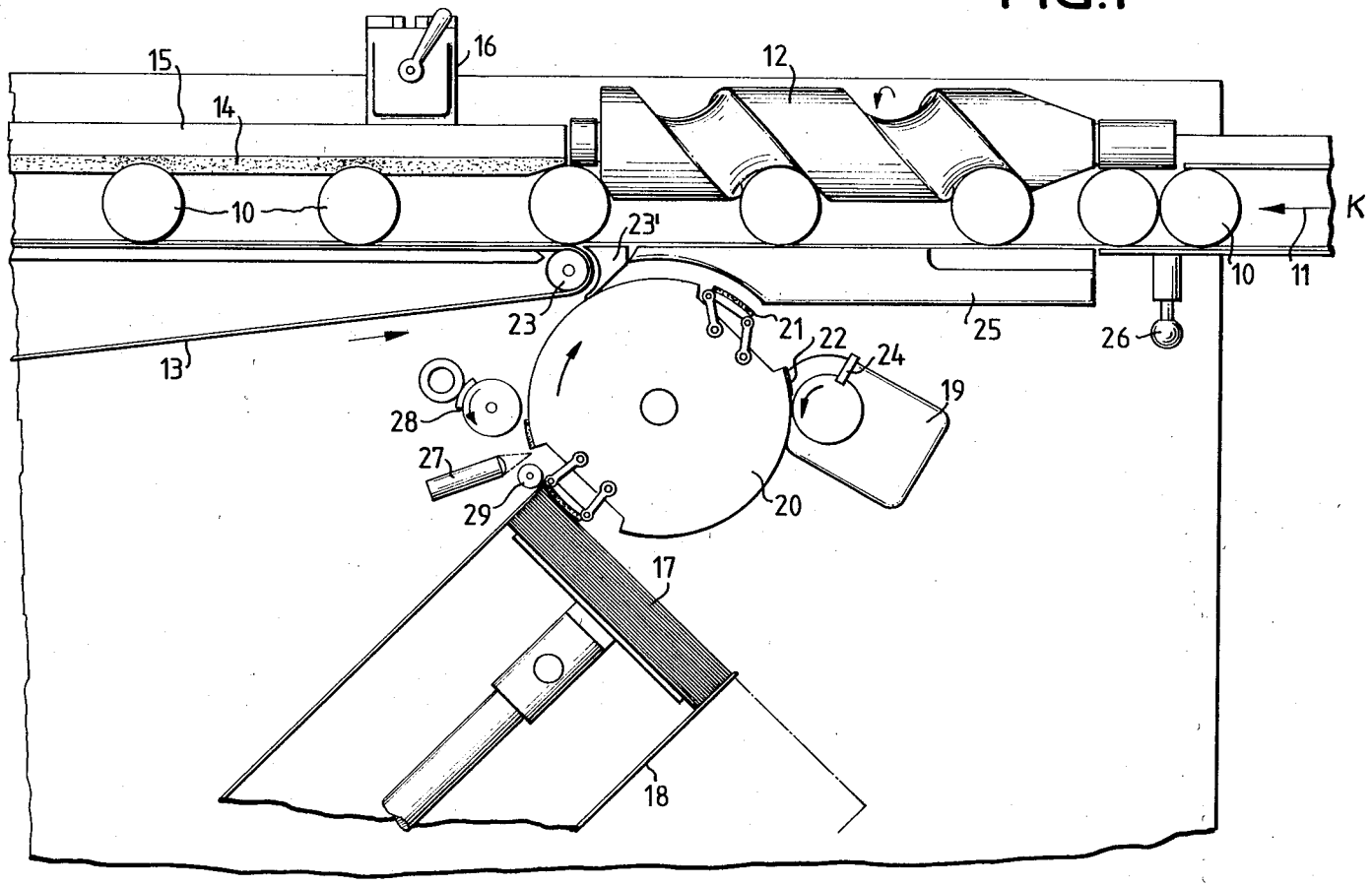
FIG. 1 is a schematic view of the device for the application of labels onto continually rolling containers, according to the invention.

Referring now to the drawings in greater detail and firstly to FIG. 1 thereof, it will be seen that cylindrical containers 10, such as cans or glass containers, which are to be provided with the labels on the outer surfaces, are guided on a conventional conveyor belt 11 in the direction of arrow K. Containers 10 are then guided by a screw conveyor 12 so as to place them in the direction of feeding K at required equal intervals from each other before they reach a working region. Containers 10 are finally transmitted onto a driving belt 13 on which they are rolled and advanced between the outer surface of belt 13 and an actual counter surface 14 which may be made for example of foamed rubber. Counter surface 14 is positioned on a counter-hold device 15, the distance of which from the upper surface of belt 13 can be adjusted by means of an adjusting device 16 of any suitable conventional type in accordance with the diameter of the container being coated with a label.

Labels 17 are disposed in stack in a box 18. Labels 17 are transmitted from the stack in box 18 by means of a label-removing-and-transmitting drum 20. The latter includes a number of label-gluing and label-gripping segments 21 and 22 distributed over the periphery of the feeding drum 20. A gluing mechanism 19 of any suitable known type is positioned on the right-hand side of drum 20. Label-transmitting drum 20 is rotated in the direction shown by the arrow. Labels 17 glued and seized by the drum segments 21 and 22 are fed over the periphery of drum 20 to a wiper 23', which is positioned in the proximity of a deflection roller 23 of the driving belt 13, and then the labels are pressed against the outer surfaces of containers 10. Containers 10 rotate between the belt 13 and counter surface 14 so that upon a complete revolution of the individual container the label wraps around the periphery of this container and sticks to that periphery. The gluing mechanism 19 has a surface feeler 24. A safety cover 25 is positioned against the screw conveyor 12. A stopper 26 serves for an instant placing of the device out of operation.

Label-gripping and transmitting segments 21 and 22 are arranged so that upon one rotation of the feeding drum 20 two containers can be provided with labels. Therefore the output of 30,000 cans or containers per hour can be obtained with 250 revolutions per minute.

Segments 21 are movable relative to the drum 20 and serve to coat with glue front ends of the labels removed from the stack while segments 22 are stationary relative to drum 20 and serve for applying the glue received from the gluing mechanism 19 to the rear ends of the labels transmitted from the stack onto the periphery of the feeding drum 20. Cold glue is applied onto the outer surfaces of segments 21 and 22, rotated together with drum 20, from the gluing mechanism 19 in the conventional fashion.

Figure 2:
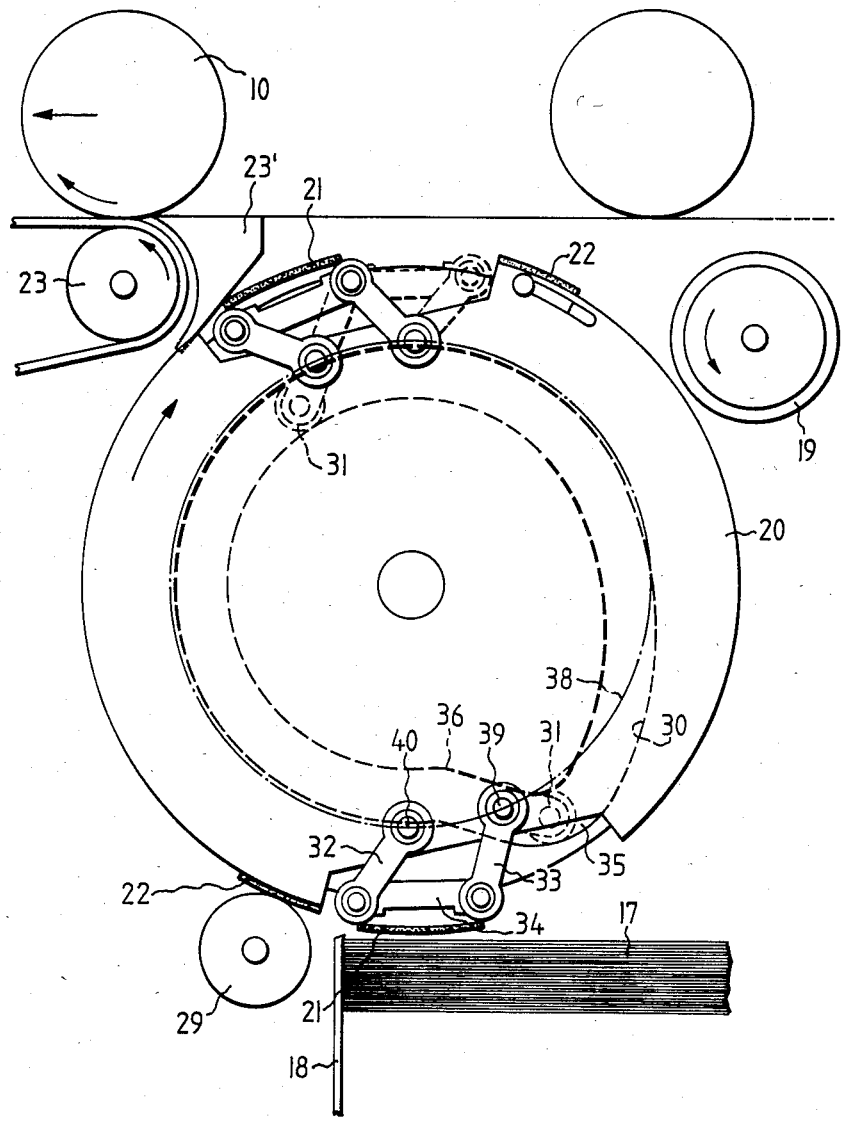
FIG. 2 is an enlarged schematic front view of the label-feeding drum in the first position A.
Figure 8:
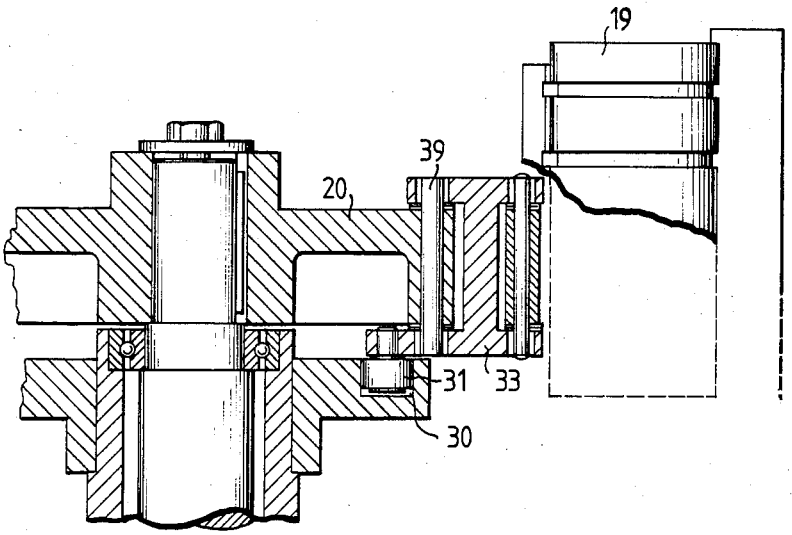
FIG. 8 is a sectional view taken on line VIII—VIII of FIG. 9 and showing the feeding drum, with a device for moving a label-gripping segment, in relation with a gluing mechanism.
Figure 9:
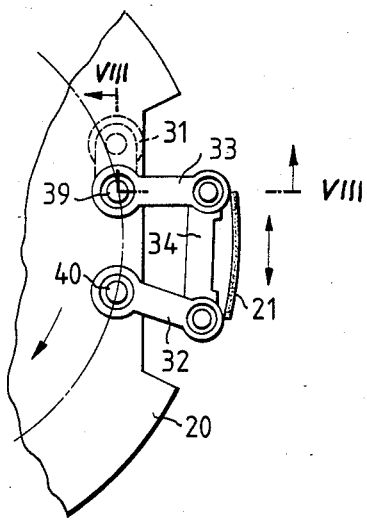
FIG. 9 is a schematic view of the movable label-gripping segment of FIG. 8.

With reference to FIGS. 2, 8 and 9 it will be seen that each movable label-gripping segment 21 is mounted on a mechanism which imparts to segment 21 the movement which will be explained below. This mechanism includes two pivotable levers or rods 32 and 33, each pivotable on a respective pivot 40 or 39, and connected to each other by an intermediate rod or lever 34. Lever 33 is connected to a cam follower 31 which is guided in a cam groove formed between the parallel cam faces of a control cam 30. Pivot points 40 and 39 of levers or rods 32 and 33 are positioned on a common circumference 38. Cam 30 has a cam surface 35 and a cam surface 36.

Referring back to FIG. 1, reference numeral 23 designates a deflection roll of the conveyor belt 13, reference numeral 27 denotes a coding sensor, 28 is any suitable data-applying device for a horizontal and vertical labelling on a front end of the label transmitted by drum 28, and 29 is a pressure roller.

Movable segment 21 is displaced under the influence of the control cam 30 in the different consecutive states so that different working positions A to F result which are illustrated in FIGS. 2 to 7.

In the position A shown in FIG. 2 the cam face 35 of the cam guide causes an oscillation of segment 21 in the forward direction toward the front end of the uppermost label 17 positioned in box 18.

Figure 3:
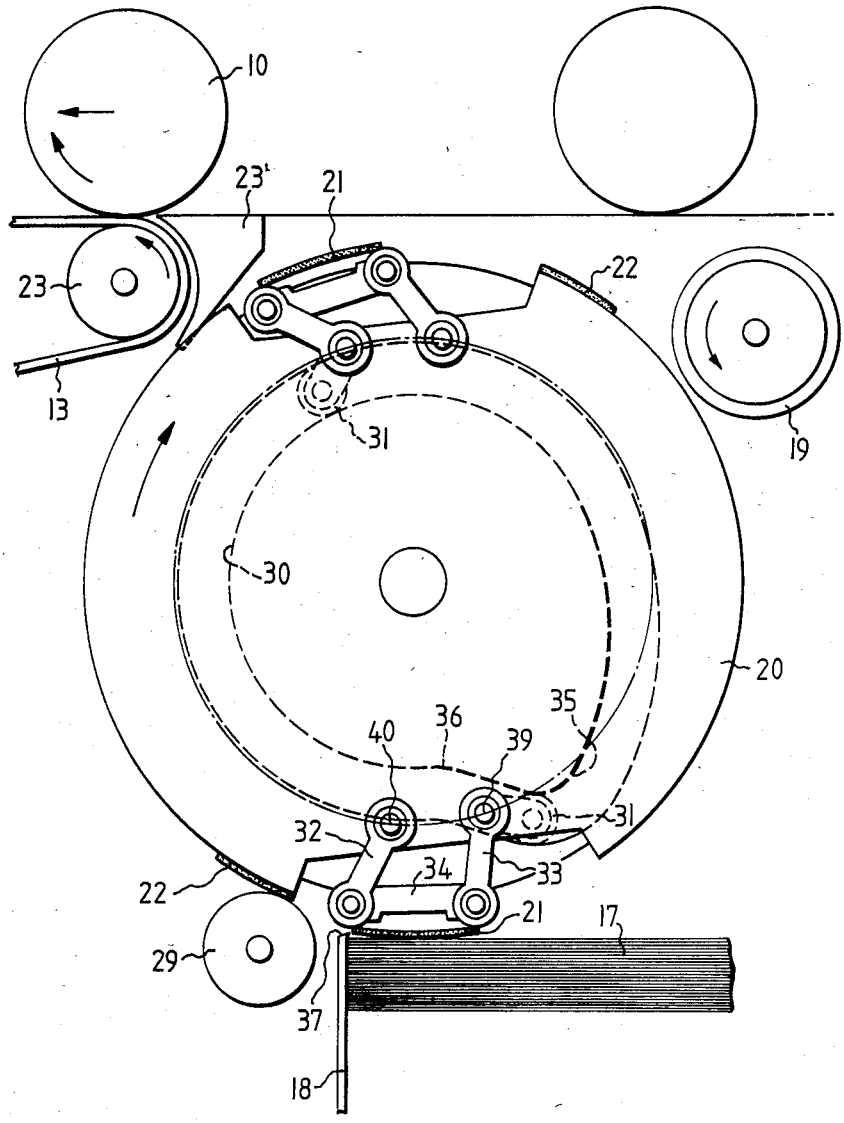
FIG. 3 is a schematic view of the feeding drum in the second position B.

In the position B of FIG. 3 the segment 21 carrying a glue thereon, which was previously applied to its outer surface from gluing mechanism 19, contacts the front end of the uppermost label, as it is again guided by the control cam 30 and levers 32, 33, 34 while the pivot points 39 and 40 remain on the circumference 38.

Figure 4:
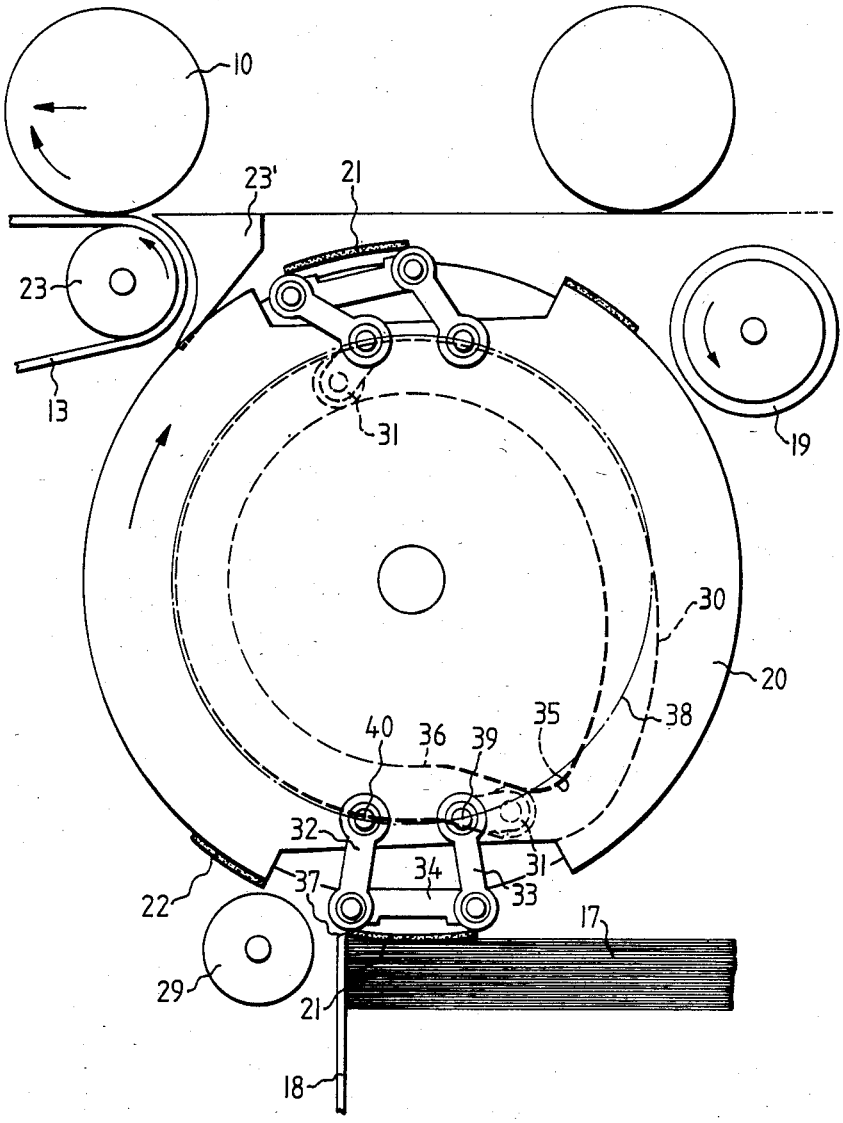
FIG. 4 is a schematic view of the feeding drum in the third position C.

In the position C of FIG. 4 segment 21 is pressed with its outer surface into the label stack.

Figure 5:
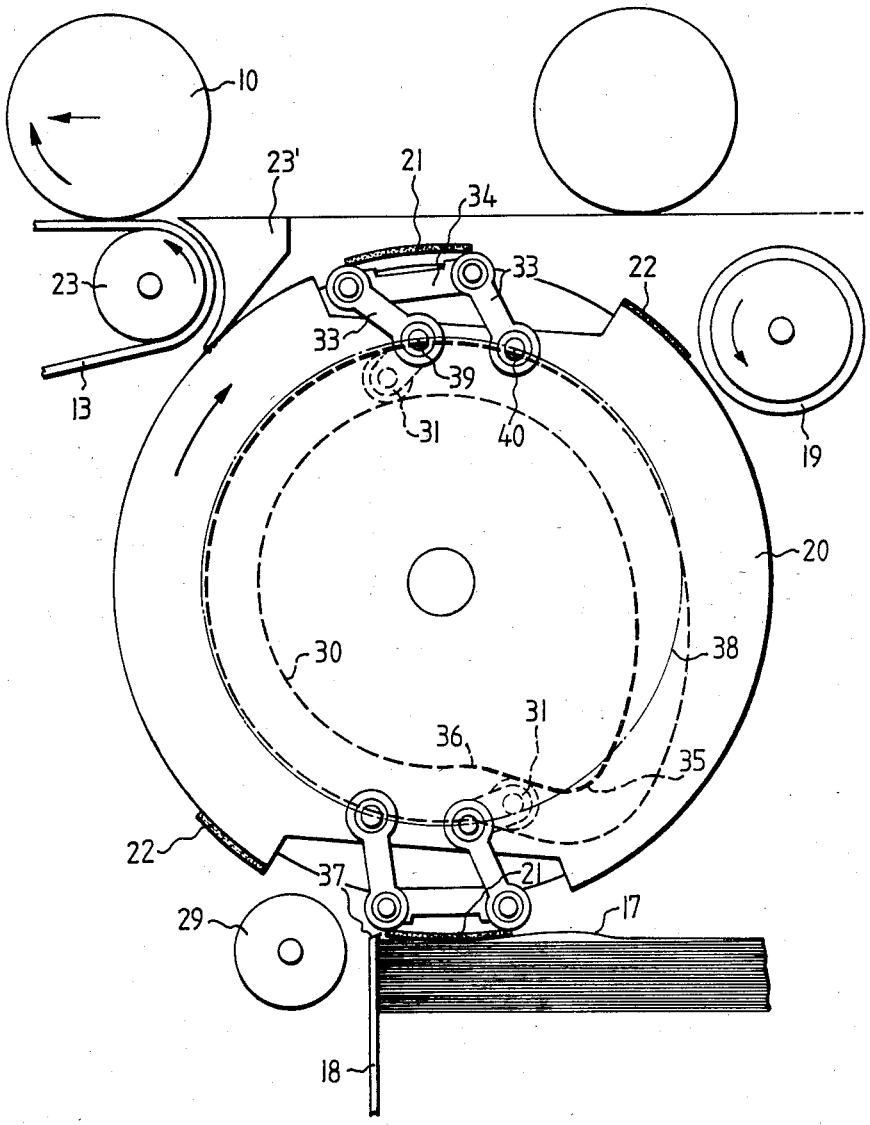
FIG. 5 is a schematic view of the feeding drum in the fourth position D.

In the position D shown in FIG. 5 the counter cam surface 36 of the control cam 30 causes segment 21 not only to start lifting off together with the uppermost label stuck thereto but also simultaneously to perform a brief rearward movement to permit the segment 21 with the label's end to slide over a projection 37 on the label box 18.

Figure 6:
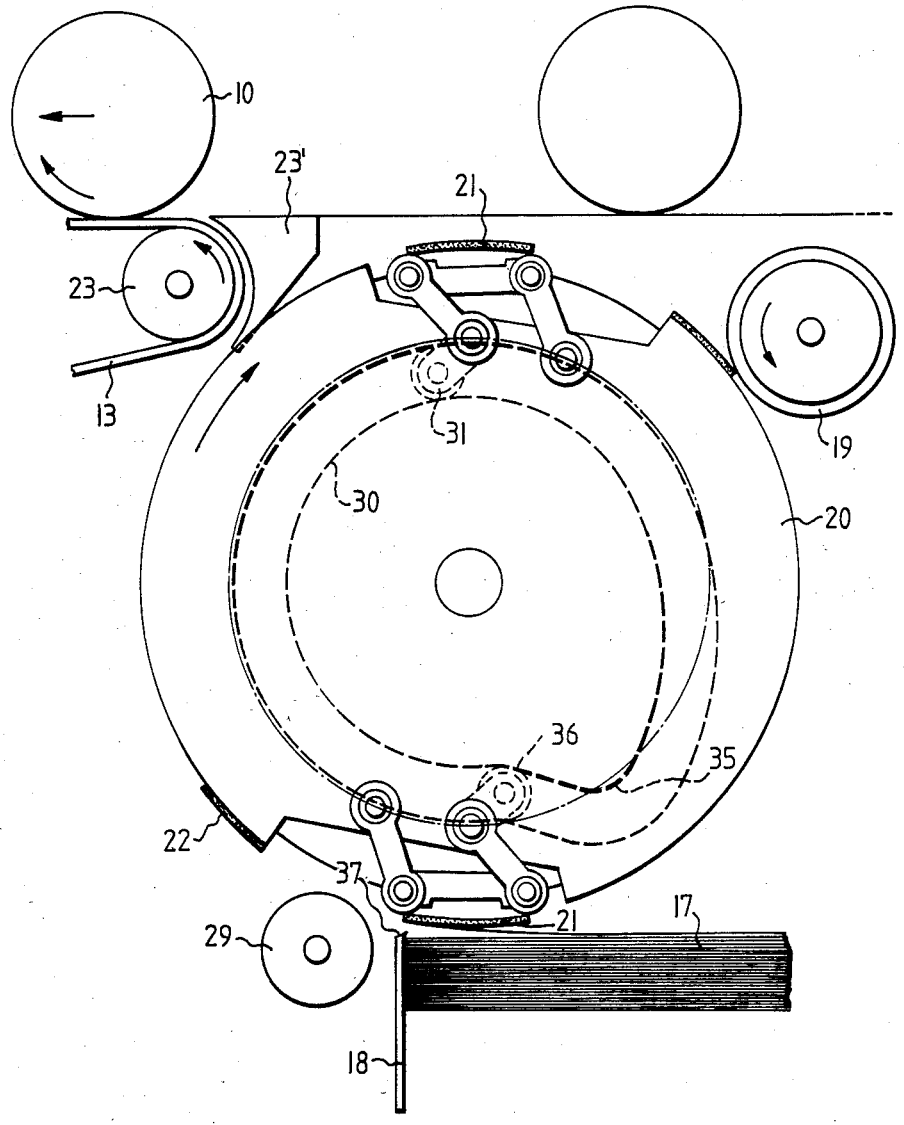
FIG. 6 is a schematic view of the feeding drum in the fifth position E.

In the position E of FIG. 6 movable segment 21 moves again forwardly and takes along the uppermost label 17 onto the periphery of the feeding drum 20.

Figure 7:
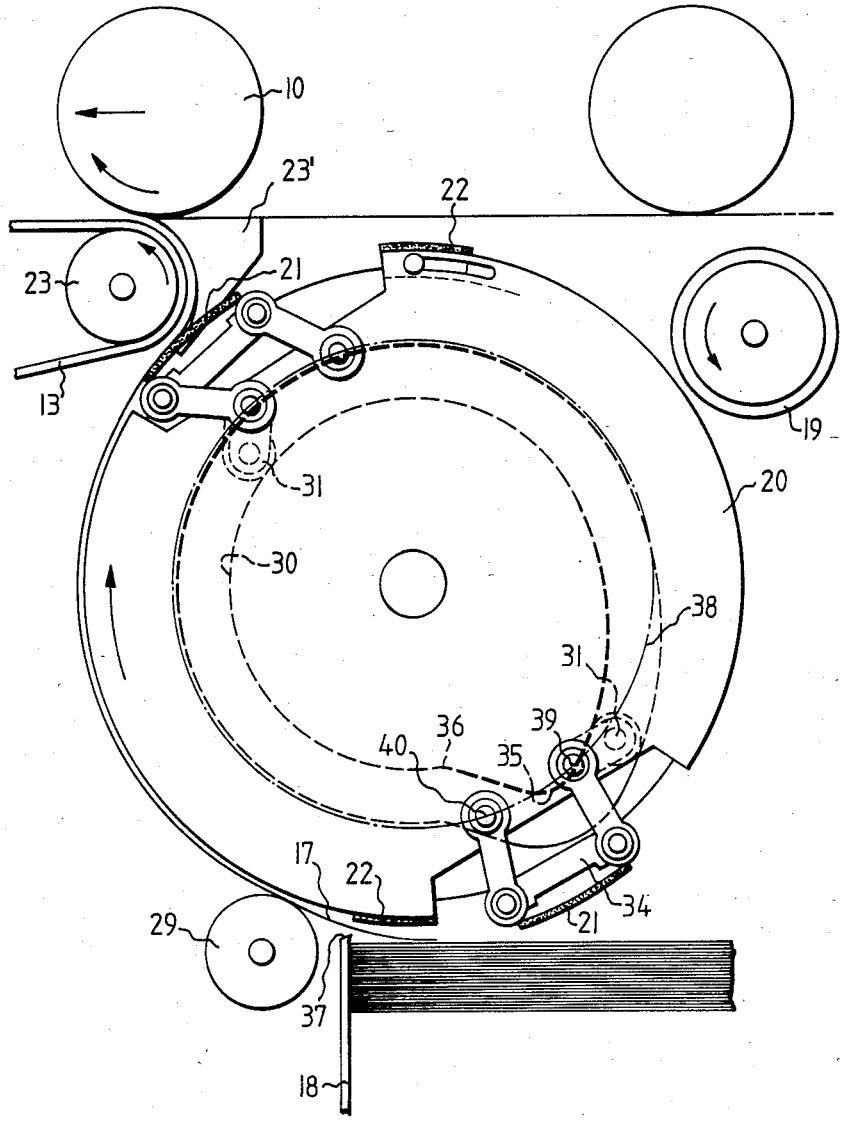
FIG. 7 is a schematic view of the feeding drum in the sixth position F.

In the position F depicted in FIG. 7 the label front end coated with glue and transmitted by segment 21 over the periphery of the rotating drum 20 arrives at the wiper 23' and the label 17 is conveyed by deflection roll 23 of the running drive belt 13 onto the container 10 which is in the work position. Container 10 at this point rolls between the outer surface of driving belt 13 and counter surface 14 whereby it is wrapped around by label 17. Meanwhile the stationary segment 22 arrives against the end of the uppermost label 17 in the stack. Stationary segment 22 applies glue with the aid of counter pressure roller 29 to the rear end of the uppermost label and takes this rear end along to convey it to the wiper 23' whereby the rear end of the label also reaches the container 10 and the wrapping of the label around container 10 is completed. As mentioned above glue was applied to the stationary segment 22, before it had reached the stack of labels in box 18, from the gluing mechanism 19.

Mechanisms for controlled movement of the movable segment 21 relative to the label stack and including rods 32, 33, 34 can be of course formed in any other suitable fashion.

The advantages of the labelling machine for applying labels to cylindrical containers, such as cans and glasses, are as follows:

The gluing of the front and rear ends of the labels is carried out by cold glue-applying mechanism instead of hot glue aggregates;

About 85% to 90% of glue saving can be achieved as compared to the conventional methods of gluing the entire label or of applying strips to the labels;

Containers 10 are guided through the machine in a straight-line orientation which requires very little space and simple supporting means;

Means for transmitting labels from the stack box to the containers are very simple, and not only a small transmission moment is obtained but also a quick adjustment to various label formats is possible;

The horizontal and vertical signs on the front side of each label positioned on the drum 20 can be applied by means of data-application device 28 or the like;

A coding sensor or reader 27 can be provided on drum 20;

Due to the provision of the stationary label box or container 18 oscillating masses are avoided and an easy insertion of longer labels into the box during the operation can be made possible; and The containers 10 are held and guided during the entire labelling process.

It will be understood that each of the elements described above, or two or more together, may also find a useful application in other types of devices for the application of labels to cylindrical containers differing from the types described above.

While the invention has been illustrated and described as embodied in a device for the application of labels to cylindrical containers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for the application of labels to cylindrical containers, comprising conveying means for advancing cylindrical containers to a work position; separating means for positioning the cylindrical containers at equal intervals from each other on said conveying means; drive means and counter surface means positioned opposite to the drive means and rolling said containers which are received from said conveying means at the work position; a gluing mechanism; label-containing box means; and a rotary label-transmitting drum positioned against said box means for removing an uppermost label from said box and transmitting said label along a periphery of the drum to said drive means and said counter surface means, said label-transmitting drum including at least one movable gripping segment which receives cold glue from said gluing mechanism and, upon the rotation of said drum, comes into contact with a front end of the uppermost label and takes said front end along upon a further rotation of the drum, and at least one stationary gripping segment which receives cold glue from said gluing mechanism and, upon rotation of said drum, comes into contact with a rear end of the uppermost label, said drum further including cam control means having a cam roller and a cam groove for guiding said cam roller, said cam control means controlling the movement of said movable segment when the latter is positioned against the front end of the uppermost label.

2. The device as defined in claim 1, wherein two movable gripping segments and two stationary gripping segments are provided on the periphery of said drum, which are offset relative to each other by 180°.

3. The device as defined in claim 1, wherein an "n" number of the movable segments and an "n" number of the stationary segments are provided on the periphery of said drum, which are offset relative to each other by 360°:n.

4. The device as defined in claim 1, wherein said movable gripping segment further includes lever means and a gripping portion, said lever means connecting said cam roller to said gripping portion.

5. The device as defined in claim 4, wherein said lever means includes two pivotable levers having pivot points which are arranged on the same circumference on said drum.

6. The device as defined in claim 5, wherein said lever means further including a rod connecting said pivotable levers to each other.

7. The device as defined in claim 6, further including a wiper at said work position and a counter pressure roller in the proximity of said box means, said movable segment under the influence of said cam roller and during a continual rotation of said drum transmits the uppermost label to said wiper, moves to said gluing mechanism to receive a new portion of cold glue therefrom, then comes into contact with a next uppermost label in said box means, moves into the stack of labels, performs a brief rearward-and-lifting movement and moves further to said wiper with the label stuck thereto whereas the stationary segment provided with glue from the gluing mechanism comes into contact with the rear end of said label and coats the latter with glue when the stationary segment passes said counter pressure roller.

* * * * *